US009242834B2

(12) United States Patent
Terry

(10) Patent No.: US 9,242,834 B2
(45) Date of Patent: Jan. 26, 2016

(54) WIRELESS DESTINATION ENTRY FOR ELEVATOR DISPATCHING SYSTEM VIA WEB PAGE THAT IS PUSHED TO A WIRELESS DEVICE

(75) Inventor: Harold Terry, New Hartford, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 756 days.

(21) Appl. No.: 13/520,636

(22) PCT Filed: Jan. 8, 2010

(86) PCT No.: PCT/US2010/020442

§ 371 (c)(1),
(2), (4) Date: Jul. 5, 2012

(87) PCT Pub. No.: WO2011/084160

PCT Pub. Date: Jul. 14, 2011

(65) Prior Publication Data

US 2012/0279808 A1 Nov. 8, 2012

(51) Int. Cl.
*B66B 1/28* (2006.01)
*B66B 1/46* (2006.01)

(52) U.S. Cl.
CPC ..... *B66B 1/468* (2013.01); *B66B 2201/4615* (2013.01); *B66B 2201/4653* (2013.01)

(58) Field of Classification Search
CPC ..... B66B 1/468; B66B 2201/4615; B66B 2201/4653
USPC ..... 187/247, 380–388, 391, 393, 396
See application file for complete search history.

(56) References Cited

U.S. PATENT DOCUMENTS 5,698,094 A 12/1997 Abdellatif et al.
6,382,363 B1 5/2002 Friedli
6,828,918 B2 * 12/2004 Bowman et al. ..... 340/4.1

(Continued)

FOREIGN PATENT DOCUMENTS

CN 1976855 A 6/2007
JP 2001253660 A 9/2001

(Continued)

OTHER PUBLICATIONS

Chinese Search Report dated Apr. 29, 2014 for Application No. 201080060844.5; Filing Date: January 8, 2010; 2 pages.

(Continued)

*Primary Examiner* — Anthony Salata
(74) *Attorney, Agent, or Firm* — Cantor Colburn LLP

(57) ABSTRACT

A method for wireless destination entry in an elevator dispatching system, the elevator dispatching system including a wireless transmitter/receiver (T/R) includes receiving a request to join a network of the T/R from a wireless device; pushing a web page from the T/R to the wireless device; receiving a service request by the T/R from the wireless device via the web page; communicating the service request from the T/R to a group controller; and dispatching an elevator car by the group controller to service the service request is provided. An elevator dispatching system and a computer program product including a computer readable storage medium contain computer code that, when executed by a computer, implements a method for wireless destination entry in an elevator dispatching system, the elevator dispatching system including a wireless transmitter/receiver, are also provided.

18 Claims, 4 Drawing Sheets

(56) References Cited

U.S. PATENT DOCUMENTS

| | | | | |
|---|---|---|---|---|
| 6,868,945 | B2 * | 3/2005 | Schuster et al. | 187/380 |
| 6,986,408 | B2 * | 1/2006 | Takeuchi | 187/380 |
| 7,162,233 | B2 * | 1/2007 | Chiba | 455/420 |
| 7,347,303 | B2 * | 3/2008 | Kontturi et al. | 187/380 |
| 7,377,364 | B2 * | 5/2008 | Tyni et al. | 187/380 |
| 8,047,333 | B2 * | 11/2011 | Finschi | 187/382 |
| 8,485,317 | B2 * | 7/2013 | Gerstenkorn et al. | 187/247 |
| 8,678,142 | B2 * | 3/2014 | Takeuchi | 187/392 |
| 8,820,486 | B2 * | 9/2014 | Gerstenkorn et al. | 187/391 |
| 2003/0159890 | A1 | 8/2003 | Schuster et al. | |
| 2007/0151809 | A1 | 7/2007 | Tyni et al. | |
| 2007/0290875 | A1 | 12/2007 | Pedrazzoli | |
| 2008/0011557 | A1 | 1/2008 | Hakala et al. | |
| 2008/0041669 | A1 | 2/2008 | Sansevero et al. | |

FOREIGN PATENT DOCUMENTS

| | | | |
|---|---|---|---|
| JP | 2002060152 | | 2/2002 |
| JP | 2002114456 | | 4/2002 |
| JP | 2002249284 | A | 9/2002 |
| JP | 2002265154 | A | 9/2002 |
| JP | 2003503292 | A | 1/2003 |
| JP | 2003092787 | A | 3/2003 |
| JP | 2003171070 | | 6/2003 |
| JP | 2003341945 | A | 12/2003 |
| JP | 2004500294 | A | 1/2004 |
| JP | 2007145462 | | 6/2007 |
| JP | 2007145462 | A | 6/2007 |
| JP | 2008504193 | A | 2/2008 |
| KR | 20040064331 | A | 7/2004 |
| KR | 1020040064331 | | 7/2004 |
| KR | 20070024579 | | 3/2007 |
| WO | W02009090207 | A1 | 7/2009 |

OTHER PUBLICATIONS

Notice of Final Rejection(Translation) for Korean Application No. 10-2012-7020723 provided by Yoon and Yang IP Law Practice Group; 3 pages.

Second Office Action (Translation) dated May 8, 2014 for Chinese Application No. 201080060844.5 filed Jan. 8, 2010 from State Intellectual Property Office, P.R. China; 3 pages.

International Search Report for International Patent Application No. PCT/US2010/020442 Filed on Jan. 8, 2010.

Written Opinion for International Patent Application No. PCT/US2010/020442 Filed on Jan. 8, 2010.

International Preliminary Report on Patentability and Written Opinion mailed Jul. 10, 2012 for International Patent Application No. PCT/US2010/020442 filed Jan. 8, 2010.

Chinese First Office Action for application CN 201080070965.8, mailed Mar. 17, 2014, 16 pages.

Korean Patent Application No. 10-2012-7020723; Reference No. PA-0012828-KR-THO; Notification of Reason(s) for Refusal; dated Sep. 11, 2013; pp. 1-4.

Chinese Search Report dated Oct. 14, 2013 for Application No. 201080060844.5; Filing Date: Jan. 8, 2010; 2 pages.

Office Action received for Great Britain Application No. GB1211400.5 dated Jan. 2, 2014; 2 pages.

Office Action dated Jan. 15, 2014 for Japanese Application No. 2012-547988; International Application No. PCT/US2010/020442; 2 pages.

Japanese Application No. 2012-547988; Office Action (Translation); Date of Draft of an Office Action: Nov. 26, 2013; 2 pages.

* cited by examiner

WIRELESS DESTINATION ENTRY FOR ELEVATOR DISPATCHING SYSTEM VIA WEB PAGE THAT IS PUSHED TO A WIRELESS DEVICE

CROSS REFERENCE TO RELATED APPLICATION

This application claims priority under 35 U.S.C. §119(a) to PCT Application No. PCT/US2010/020442, filed on Jan. 8, 2010.

FIELD OF INVENTION

The subject matter disclosed herein generally to the field of elevator dispatching systems.

DESCRIPTION OF RELATED ART

An elevator dispatching system may comprise one or more destination entry devices located at each floor which passengers may use to request service. The destination entry devices may comprise up and down call buttons, allowing the passengers to enter the direction of their destination, or a key pad to enter their destination floor. Such destination entry devices are static, and if a large number of passengers are gathered at a particular floor, it may be difficult for a passenger to enter a request for elevator service in a timely manner.

BRIEF SUMMARY

According to one aspect of the invention, a method for wireless destination entry in an elevator dispatching system, the elevator dispatching system comprising a wireless transmitter/receiver (T/R) includes receiving a request to join a network of the T/R from a wireless device; pushing a web page from the T/R to the wireless device; receiving a service request by the T/R from the wireless device via the web page; communicating the service request from the T/R to a group controller; and dispatching an elevator car by the group controller to service the service request.

According to another aspect of the invention, an elevator dispatching system includes a wireless transmitter/receiver (T/R), the T/R being in communication with a group controller of the elevator dispatching system, the T/R configured to receive a request to join a network of the T/R from a wireless device; push a web page from the T/R to the wireless device; receive a service request by the T/R from the wireless device via the web page; and communicate the service request from the T/R to the group controller, wherein the group controller is configured to dispatch an elevator car to service the service request.

According to yet another aspect of the invention, a computer program product comprising a computer readable storage medium containing computer code that, when executed by a computer, implements a method for wireless destination entry in an elevator dispatching system, the elevator dispatching system comprising a wireless transmitter/receiver (T/R), includes receiving a request to join a network of the T/R from a wireless device; pushing a web page from the T/R to the wireless device; receiving a service request by the T/R from the wireless device via the web page; communicating the service request from the T/R to a group controller; and dispatching an elevator car by the group controller to service the service request.

Other aspects, features, and techniques of the invention will become more apparent from the following description taken in conjunction with the drawings.

BRIEF DESCRIPTION OF THE SEVERAL VIEWS OF THE DRAWINGS

Referring now to the drawings wherein like elements are numbered alike in the several FIGURES.

DETAILED DESCRIPTION

Embodiments of systems and methods for wireless destination entry in an elevator dispatching system are provided, with exemplary embodiments being discussed below in detail. A wireless transmitter/receiver (T/R) that is in communication with an group controller of the elevator system may be installed at each floor of an elevator system. A passenger may use a web browser on a wireless device to communicate with the T/R in order to enter a service request. Use of the web browser allows use of any web-enabled wireless device to enter a destination; no specialized software needs to be loaded on a wireless device to allow the wireless device to communicate with the elevator dispatching system.

Figure 1:
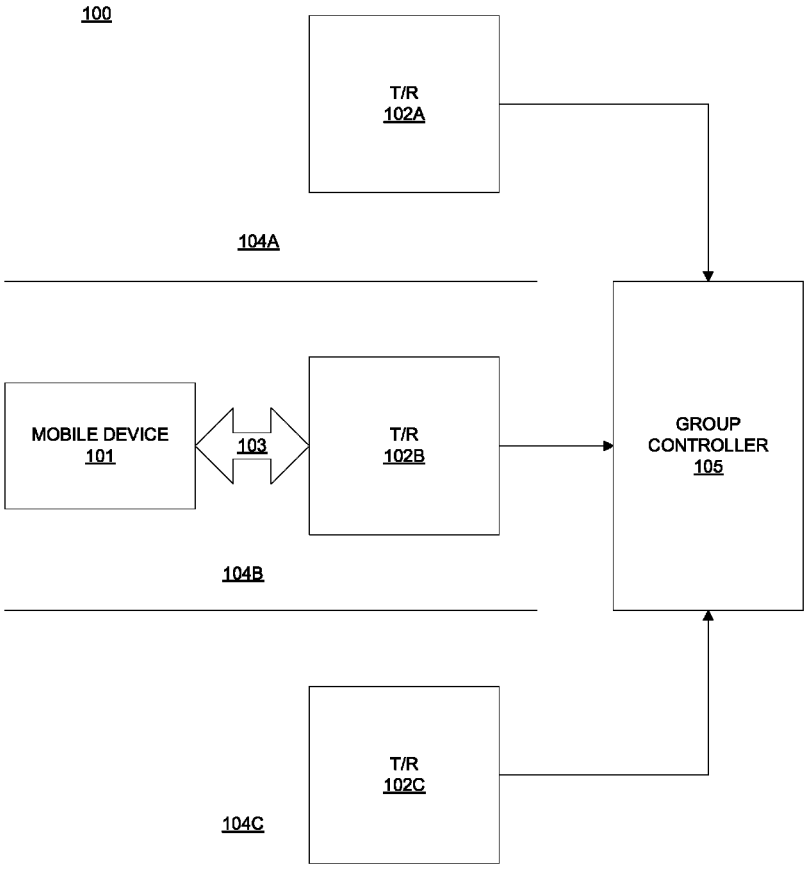
FIG. 1 illustrates an embodiment of an elevator dispatching system comprising wireless destination entry.

FIG. 1 illustrates an embodiment of an elevator dispatching system 100 comprising wireless destination entry. Elevator dispatching system 100 comprises a plurality of T/Rs 102A-C, each located on a respective floor 104A-C. Each of T/Rs 102A-C may be located on a different floor in some embodiments; in other embodiments, a single floor may comprise a plurality of T/Rs. T/Rs 102A-C are shown for illustrative purposes only; an elevator dispatching system may comprise any appropriate number and configuration of T/R devices. Each of T/Rs 102A-C transmits and receives wireless signals, such as wireless signal 103; the wireless signals may comprise any appropriate wireless protocol, including but not limited to R/F, Bluetooth, 802.11 wifi, or infrared. A T/R may be configured to have a range such that wireless signals from one T/R may not be received by T/Rs on other floors. Each of T/Rs 102A-C is in communication with a group controller 105 that controls the elevator cars of the elevator dispatching system 100.

Wireless device 101 is in communication with T/R 102B via wireless signal 103. Wireless device 101 comprises a web browser that may display a web page. Wireless device 101 may comprise any appropriate wireless device having a web browser, including but not limited to a cellular phone, personal digital assistant (PDA), or laptop.

Figure 2:
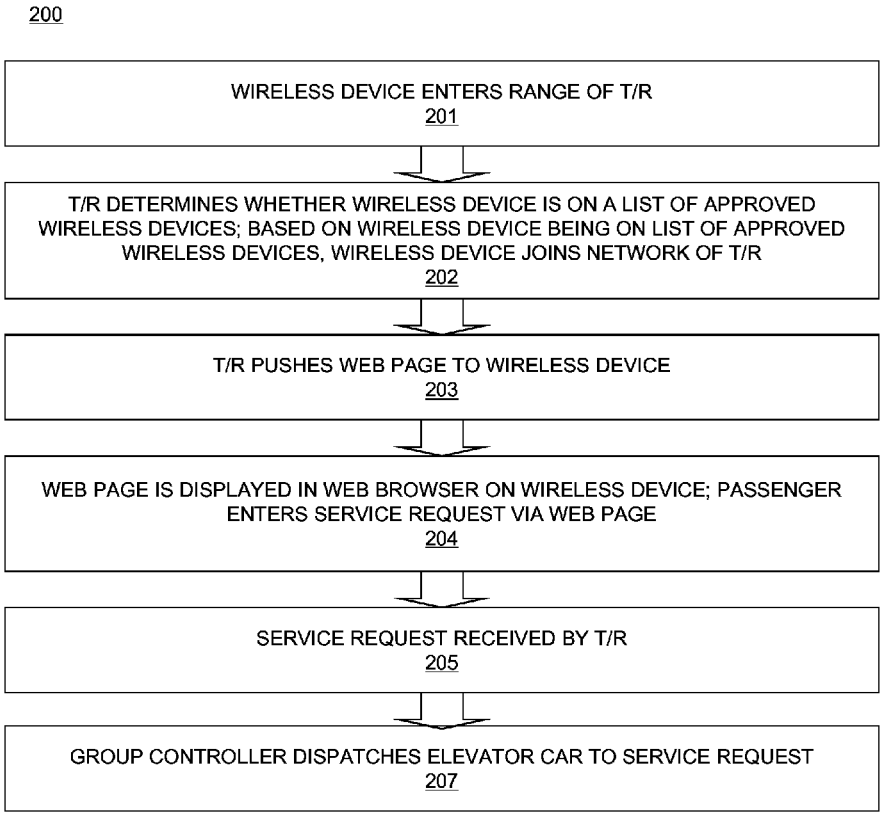
FIG. 2 illustrates an embodiment of a method for wireless destination entry in an elevator dispatching system.

FIG. 2 illustrates a method 200 for wireless destination entry in an elevator dispatching system. FIG. 2 is discussed with reference to FIG. 1. In block 201, the wireless device 101 comes in range of T/R 102B, and receives wireless signal 103. In block 202, the wireless device 101 joins the network of T/R 102B. In some embodiments, wireless device 101 may be required to transmit a password to T/R 102B in order to join the network of T/R 102B. In some embodiments, T/Rs 102A-C may have access to a list of approved device identifiers (IDs); in such an embodiment, only wireless devices that are on the list of device IDs may be permitted to join the network of any of T/Rs A-C. In block 203, T/R 102B pushes a file comprising a web page to the wireless device 101 via wireless signal 103. In block 204, the web page is displayed on a web browser on wireless device 101, and a passenger uses the web page displayed in the web browser of wireless device 101 to enter a service request, which may comprise a destination floor. In some embodiments, wireless device 101 may be required to transmit a password to T/R 102B in order to enter the service request. In some embodiments, T/Rs 102A-C may have access to a list of approved device identifiers (IDs); in such an embodiment, only wireless devices that are on the list of device IDs may be permitted to submit a service request to any of T/Rs 102A-C. In block 205, the service request is received by T/R 102B via wireless signal 103. In block 206, the service request is communicated from T/R 102B to a group controller 105 of the elevator system 100 that is in communication with each of T/Rs 102A-C. In block 207, the group controller 105 dispatches an elevator car to service the request.

Figure 3:
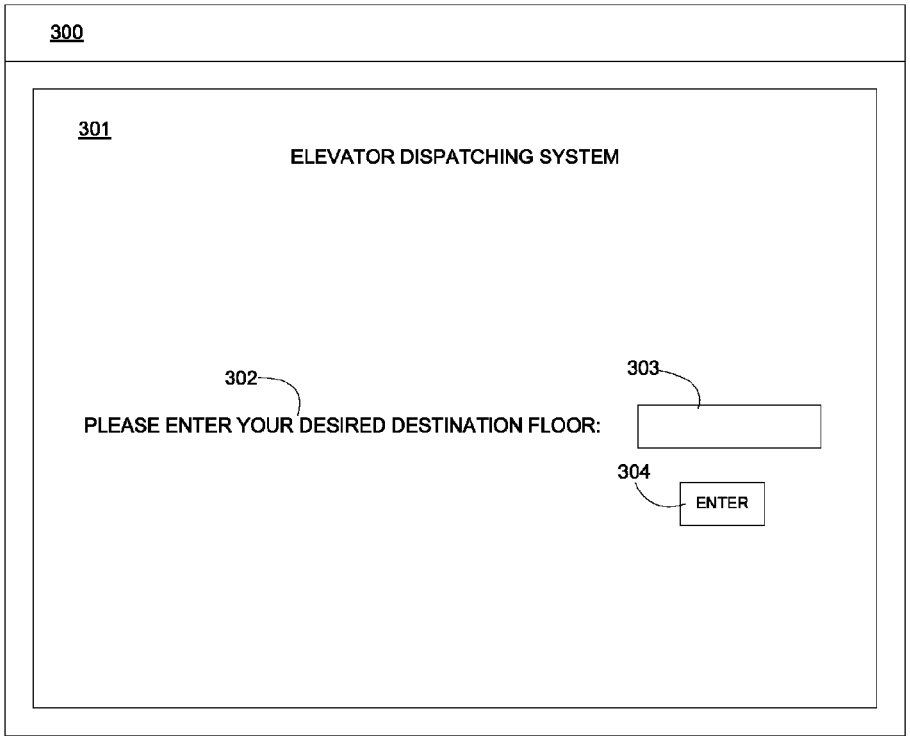
FIG. 3 illustrates an embodiment of a web page that may be used in conjunction with systems and methods for wireless destination entry in an elevator dispatching system.

FIG. 3 illustrates an embodiment of a web page 301 that may be received by any of T/Rs 102A-C, and displayed in a web browser 300 on wireless device 101. Web browser 300 may comprise any appropriate web browser that is capable of displaying a web page, including but not limited to Internet Explorer®, Safari®, Firefox®, Chrome®, or Opera®. Web page 301 may comprise any appropriate file type that may be displayed by web browser 300, including but not limited to .jsp, .asp, .php, .htm, .html or .xml. Web page 301 comprises a prompt 302, a data entry field 303, and a button 304 that may be clicked in order to send a destination entered into data entry field 303 to T/R 102B. Web page 301 is shown for illustrative purposes only; web page 301 may comprise any web page capable of being displayed by a web browser 300 that is capable of communicating a service request from a passenger to any of T/Rs 102A-C.

Figure 4:
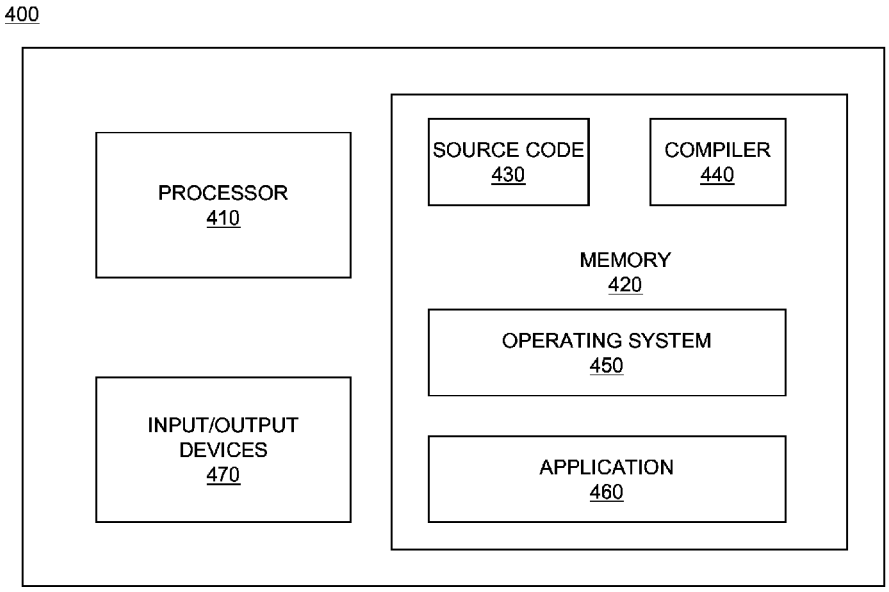
FIG. 4 PRIOR ART
FIG. 4 illustrates an embodiment of a computer that may be used in conjunction with systems and methods for wireless destination entry in an elevator dispatching system.

FIG. 4 illustrates an example of a computer 400 which may be utilized by exemplary embodiments of systems and methods for wireless destination entry in an elevator dispatching system as embodied in software. Various operations discussed above may utilize the capabilities of the computer 400. One or more of the capabilities of the computer 400 may be incorporated in any element, module, application, and/or component discussed herein, including wireless device 101 and T/Rs 102A-C.

The computer 400 includes, but is not limited to, PCs, workstations, laptops, PDAs, palm devices, servers, storages, and the like. Generally, in terms of hardware architecture, the computer 400 may include one or more processors 410, memory 420, and one or more input and/or output (I/O) devices 470 that are communicatively coupled via a local interface (not shown). The local interface can be, for example but not limited to, one or more buses or other wired or wireless connections, as is known in the art. The local interface may have additional elements, such as controllers, buffers (caches), drivers, repeaters, and receivers, to enable communications. Further, the local interface may include address, control, and/or data connections to enable appropriate communications among the aforementioned components.

The processor 410 is a hardware device for executing software that can be stored in the memory 420. The processor 410 can be virtually any custom made or commercially available processor, a central processing unit (CPU), a digital signal processor (DSP), or an auxiliary processor among several processors associated with the computer 400, and the processor 410 may be a semiconductor based microprocessor (in the form of a microchip) or a macroprocessor.

The memory 420 can include any one or combination of volatile memory elements (e.g., random access memory (RAM), such as dynamic random access memory (DRAM), static random access memory (SRAM), etc.) and nonvolatile memory elements (e.g., ROM, erasable programmable read only memory (EPROM), electronically erasable programmable read only memory (EEPROM), programmable read only memory (PROM), tape, compact disc read only memory (CD-ROM), disk, diskette, cartridge, cassette or the like, etc.). Moreover, the memory 420 may incorporate electronic, magnetic, optical, and/or other types of storage media. Note that the memory 420 can have a distributed architecture, where various components are situated remote from one another, but can be accessed by the processor 410.

The software in the memory 420 may include one or more separate programs, each of which comprises an ordered listing of executable instructions for implementing logical functions. The software in the memory 420 includes a suitable operating system (O/S) 450, compiler 440, source code 430, and one or more applications 460 in accordance with exemplary embodiments. As illustrated, the application 460 comprises numerous functional components for implementing the features and operations of the exemplary embodiments. The application 460 of the computer 400 may represent various applications, computational units, logic, functional units, processes, operations, virtual entities, and/or modules in accordance with exemplary embodiments, but the application 460 is not meant to be a limitation.

The operating system 450 controls the execution of other computer programs, and provides scheduling, input-output control, file and data management, memory management, and communication control and related services. It is contemplated by the inventors that the application 460 for implementing exemplary embodiments may be applicable on all commercially available operating systems.

Application 460 may be a source program, executable program (object code), script, or any other entity comprising a set of instructions to be performed. When a source program, then the program is usually translated via a compiler (such as the compiler 440), assembler, interpreter, or the like, which may or may not be included within the memory 420, so as to operate properly in connection with the O/S 450. Furthermore, the application 460 can be written as an object oriented programming language, which has classes of data and methods, or a procedure programming language, which has routines, subroutines, and/or functions, for example but not limited to, C, C++, C#, Pascal, BASIC, API calls, HTML, XHTML, XML, ASP scripts, FORTRAN, COBOL, Perl, Java, ADA, .NET, and the like.

The I/O devices 470 may include input devices such as, for example but not limited to, a mouse, keyboard, scanner, microphone, camera, etc. Furthermore, the I/O devices 470 may also include output devices, for example but not limited to a printer, display, etc. Finally, the I/O devices 470 may further include devices that communicate both inputs and outputs, for instance but not limited to, a NIC or modulator/demodulator (for accessing remote devices, other files, devices, systems, or a network), a radio frequency (RF) or other transceiver, a telephonic interface, a bridge, a router, etc. The I/O devices 470 also include components for communicating over various networks, such as the Internet or intranet.

If the computer 400 is a PC, workstation, intelligent device or the like, the software in the memory 420 may further include a basic input output system (BIOS) (omitted for simplicity). The BIOS is a set of essential software routines that initialize and test hardware at startup, start the O/S 450, and support the transfer of data among the hardware devices. The BIOS is stored in some type of read-only-memory, such as ROM, PROM, EPROM, EEPROM or the like, so that the BIOS can be executed when the computer 400 is activated.

When the computer 400 is in operation, the processor 410 is configured to execute software stored within the memory 420, to communicate data to and from the memory 420, and to generally control operations of the computer 400 pursuant to the software. The application 460 and the O/S 450 are read, in whole or in part, by the processor 410, perhaps buffered within the processor 410, and then executed.

When the application 460 is implemented in software it should be noted that the application 460 can be stored on virtually any computer readable medium for use by or in connection with any computer related system or method. In the context of this document, a computer readable medium may be an electronic, magnetic, optical, or other physical device or means that can contain or store a computer program for use by or in connection with a computer related system or method.

The application 460 can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium.

More specific examples (a nonexhaustive list) of the computer-readable medium may include the following: an electrical connection (electronic) having one or more wires, a portable computer diskette (magnetic or optical), a random access memory (RAM) (electronic), a read-only memory (ROM) (electronic), an erasable programmable read-only memory (EPROM, EEPROM, or Flash memory) (electronic), an optical fiber (optical), and a portable compact disc memory (CDROM, CD R/W) (optical). Note that the computer-readable medium could even be paper or another suitable medium, upon which the program is printed or punched, as the program can be electronically captured, via for instance optical scanning of the paper or other medium, then compiled, interpreted or otherwise processed in a suitable manner if necessary, and then stored in a computer memory.

In exemplary embodiments, where the application 460 is implemented in hardware, the application 460 can be implemented with any one or a combination of the following technologies, which are well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

The technical effects and benefits of exemplary embodiments include allowing a passenger to enter a service request for an elevator dispatching system via a wireless device without loading specialized software the wireless device.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while various embodiment of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method for wireless destination entry in an elevator dispatching system, the elevator dispatching system comprising a wireless transmitter/receiver (T/R), the method comprising:

receiving a request to join a network of the T/R from a wireless device;

determining whether the wireless device is on a list of approved wireless devices based on a device identifier of the wireless device;

based on determining that the wireless device is on the list of approved wireless devices based on the device identifier of the wireless device, pushing a web page from the T/R to the wireless device;

receiving a service request by the T/R from the wireless device via the web page;

communicating the service request from the T/R to a group controller; and dispatching an elevator car by the group controller to service the service request.

2. The method of claim 1, wherein the elevator dispatching system comprises a plurality of T/Rs in communication with the group controller, each of the plurality of T/Rs configured to transmit and receive wireless signals.

3. The method of claim 2, wherein the T/Rs are arranged such that wireless signals from one T/R on a particular floor are not received by another T/R of the plurality of T/Rs that is on another floor that is distinct from the particular floor.

4. The method of claim 1, wherein the web page comprises a data entry field for entry of the service request by a user.

5. The method of claim 1, wherein the service request comprises a destination floor.

6. The method of claim 1, further comprising receiving a password from the wireless device by the T/R.

7. An elevator dispatching system, comprising:

a wireless transmitter/receiver (T/R), the T/R being in communication with a group controller of the elevator dispatching system, the T/R configured to:

receive a request to join a network of the T/R from a wireless device;

determine whether the wireless device is on a list of approved wireless devices based on a device identifier of the wireless device;

based on determining that the wireless device is on the list of approved wireless devices based on the device identifier of the wireless device, push a web page from the T/R to the wireless device;

receive a service request by the T/R from the wireless device via the web page; and communicate the service request from the T/R to the group controller, wherein the group controller is configured to dispatch an elevator car to service the service request.

8. The elevator dispatching system of claim 7, wherein the elevator dispatching system comprises a plurality of T/Rs in communication with the group controller, each of the plurality of T/Rs configured to transmit and receive wireless signals.

9. The elevator dispatching system of claim 8, wherein the T/Rs are arranged such that wireless signals from one T/R on a particular floor are not received by another T/R of the plurality of T/Rs that is on another floor that is distinct from the particular floor.

10. The elevator dispatching system of claim 7, wherein the web page comprises a data entry field for entry of the service request by a user.

11. The elevator dispatching system of claim 7, wherein the service request comprises a destination floor.

12. The elevator dispatching system of claim 7, further comprising receiving a password from the wireless device by the T/R.

13. A computer program product comprising a non-transitory computer readable storage medium containing computer code that, when executed by a computer, implements a method for wireless destination entry in an elevator dispatching system, the elevator dispatching system comprising a wireless transmitter/receiver (T/R), wherein the method comprises:

receiving a request to join a network of the T/R from a wireless device;

determining whether the wireless device is on a list of approved wireless devices based on a device identifier of the wireless device;

based on determining that the wireless device is on the list of approved wireless devices based on the device identifier of the wireless device, pushing a web page from the T/R to the wireless device;

receiving a service request by the T/R from the wireless device via the web page;

communicating the service request from the T/R to a group controller; and dispatching an elevator car by the group controller to service the service request.

14. The computer program product according to claim 13, wherein the elevator dispatching system comprises a plurality of T/Rs in communication with the group controller, each of the plurality of T/Rs configured to transmit and receive wireless signals.

15. The computer program product according to claim 14, wherein the T/Rs are arranged such that wireless signals from one T/R on a particular floor are not received by another T/R of the plurality of T/Rs that is on another floor that is distinct from the particular floor.

16. The computer program product according to claim 13, wherein the web page comprises a data entry field for entry of the service request by a user.

17. The computer program product according to claim 13, wherein the service request comprises a destination floor.

18. The computer program product of claim 13, further comprising receiving a password from the wireless device by the T/R.

* * * * *